US008128211B2

(12) United States Patent
Chung et al.

(10) Patent No.: US 8,128,211 B2
(45) **Date of Patent: *Mar. 6, 2012**

(54) INK-CARTRIDGE FOR PRINTERS

(75) Inventors: Kwang-Choon Chung, Kyeongki-do (KR); Chang-Soo Yu, Kyeongki-do (KR); Nam-Boo Cho, Kyeongki-do (KR); Young-Chul Shin, Kyeongki-do (KR); Bae-Song Heo, Kyeongki-do (KR)

(73) Assignee: Inktec Co., Ltd, Kyeongki-do (KR)

( * ) Notice: Subject to any disclaimer, the term of this patent is extended or adjusted under 35 U.S.C. 154(b) by 703 days.

This patent is subject to a terminal disclaimer.

(21) Appl. No.: 12/091,496

(22) PCT Filed: Oct. 25, 2006

(86) PCT No.: PCT/KR2006/004383

§ 371 (c)(1),
(2), (4) Date: Nov. 7, 2008

(87) PCT Pub. No.: WO2007/049919

PCT Pub. Date: May 3, 2007

(65) Prior Publication Data

US 2009/0073245 A1 Mar. 19, 2009

(30) Foreign Application Priority Data

Oct. 25, 2005 (KR) ..... 10-2005-0100724
Mar. 18, 2006 (KR) ..... 10-2006-0025095

(51) Int. Cl.
*B41J 2/175* (2006.01)

(52) U.S. Cl. ..... 347/86; 347/84; 347/85

(58) Field of Classification Search ..... None
See application file for complete search history.

(56) References Cited

U.S. PATENT DOCUMENTS

| | | | | |
|---|---|---|---|---|
| 6,000,791 | A | 12/1999 | Scheffelin et al. | |
| 6,283,588 | B1 | 9/2001 | Brandon et al. | |
| 6,817,707 | B1 | 11/2004 | Fowler et al. | |
| 7,303,271 | B2 * | 12/2007 | Shimizu et al. | 347/94 |
| 2002/0044182 | A1 | 4/2002 | Hou et al. | |
| 2003/0122907 | A1 | 7/2003 | Kim | |
| 2004/0051766 | A1 * | 3/2004 | Miyazawa et al. | 347/86 |
| 2004/0100537 | A1 | 5/2004 | Lui et al. | |

FOREIGN PATENT DOCUMENTS

| | | |
|---|---|---|
| EP | 0826505 | 3/1998 |
| EP | 0841174 | 5/1998 |
| EP | 1199178 | 4/2002 |
| JP | 2007025021 | 1/2007 |

* cited by examiner

*Primary Examiner* — Matthew Luu
*Assistant Examiner* — Erica Lin
(74) *Attorney, Agent, or Firm* — Lowe Hauptman Ham & Berner, LLP

(57) ABSTRACT

The present invention relates to an ink-cartridge for printers comprising a body formed having a filling hole on an upper surface thereof; a plurality of filling chambers inside of the body divided by a partition having a connecting hole; a discharging chamber connected to the filling chamber; an air chamber connected to the filling chamber via an air transferring channel so as to supply air to the filling chamber; an air suction valve installed in the air chamber; an air inducing channel inducing external air to the air suction valve; a blocking film attached to one surface of the body; and a cover installed in the other side surface of the body; and a pressure regulating part formed in a surface of an outer wall of the body and communicating with the filling chamber.

13 Claims, 5 Drawing Sheets

PRIOR ART

PRIOR ART

INK-CARTRIDGE FOR PRINTERS

RELATED APPLICATIONS

The present application is based on, and claims priority from, KR Application Number 10-2005-0100724, filed Oct. 25, 2005; KR Application Number 10-2006-0025095, filed Mar. 18, 2006; and PCT Application Number KR06/004383, filed Oct. 25, 2006, the disclosures of which are hereby incorporated by reference herein in their entireties.

TECHNICAL FIELD

The present invention relates to an ink-cartridge for printers, and more particularly to an ink-cartridge for printers, in which a space filled with ink is expanded and generation of bubbles and reverse flow of ink due to free movement of the ink can be prevented as well.

BACKGROUND ART

Generally, printers are used as a device for outputting documents or pictures drawn up using computer on papers, and the printers include a dot matrix printer, an ink-jet printer and a laser beam printer; the ink-jet printer 100, as shown in FIG. 1, is provided with a cartridge deliverer 110 movably installed in an inside of the printer 100, and the cartridge deliverer 110 has a space into which an ink-cartridge 120 is removably mounted, a needle 111 sucking in ink filled in the ink-cartridge 120 and a head 112 injecting the ink transferred through the needle.

Although shape and structure of the ink-cartridge vary as a kind of the printer, generally the ink-cartridge, as shown in FIG. 1, has a predetermined size in order to be installed in the printer and provided with a body 200 formed with an accommodating part 201 therein and a fixing arm 202 extended from a side surface of the body 200 for fixing the body to the cartridge deliverer 110 of the printer.

Meanwhile, a sponge 210 in which the ink is impregnated is embedded in the accommodating part 201 formed in the body 200, a discharging port 220 through which the ink impregnated in the sponge 210 is discharged is formed at a lower surface of the body 200 and a packing member 205 which can prevent ink from flow in conjunction with the ink suction needle 111 is installed in an inside of the discharging port 220.

Further, a through hole 203 for supplying external air to an inside of the body 200 is formed at a selected position on an upper surface of the body 200.

Consequently, during an operation of the printer, the ink is injected from the head 112 to print a document or a picture while the cartridge deliverer 110 is moved by an electric signal from a control part of the printer, and the ink is continuously supplied from the accommodating part 201 through the ink discharging port 220 and the ink suction needle 111 to the head, whereby continuous printing is possible.

However, in the conventional ink-cartridge as such, because the sponge 210 in which the ink is impregnated is embedded in the inside of the body 200, there were problems that manufacturing cost is increased as a process for embedding the sponge 210 in the body 200 is added and a space into which the ink is filled is downsized as well.

The sponge 210 may be removed from the inside of the body 200 to solve the above problems, but there was another problem that minute bubbles are generated in the ink as the ink is freely moved when the ink-cartridge is installed in the head and then discharged through the discharging port 220 together with the ink thereby resulting a falling-off in quality of output matter.

Further, there is a problem that the ink can not be discharged in spite of the printing signal from the control part of the printer thereby resulting a falling-off in quality of printed matter, as negative pressure is generated in some space of the inside of the ink-cartridge body 200 by free movement of the ink and thus ink filled in the ink suction needle 111 or head 112 is reversely flowed.

DISCLOSURE

Technical Problem

An object of the present invention is to provide an ink-cartridge for printers, in which inner space of a body is divided into a plurality of chambers by forming a plurality of partitions in an inside of the body in which ink is filled, and an ink discharging chamber, which is connected to an ink discharging port via an ink transferring channel, is provided so as to maintain pressure of an inside of the cartridge uniformly, whereby excellent output matter can be obtained.

Another object of the present invention is to provide an ink-cartridge for printers, in which a pressure regulating part is formed at an outside wall of the cartridge in which ink is filled and thus a pressure increment inside the cartridge can be canceled out so as to solve a problem that pressure of an inside of the cartridge is increased when temperatures in an inside and an outside of the cartridge are increased and thus ink flow is occurred through an ink discharging port.

Technical Solution

To achieve the above objects, the present invention provides an ink-cartridge for printers comprising a body formed in a predetermined size and having a filling hole on an upper surface thereof; a plurality of filling chambers inside of the body divided by a partition having a connecting hole; a discharging chamber connected to the filling chamber; an air chamber connected to the filling chamber via an air transferring channel so as to supply air to the filling chamber; an air suction valve installed in the air chamber; an air inducing channel inducing external air to the air suction valve; a blocking film attached to one surface of the body; and a cover installed in the other surface of the body; and a pressure regulating part formed in a surface of an outer wall of the body and communicating with the filling chamber. The pressure regulating part is communicates with the filling chamber via a plurality of communicating ports and the plurality of the communicating ports are formed in each of the inner space of the filling chamber which is divided by the partition. Further, the pressure regulating part forms a specific space by the blocking film and the blocking film which is attached to the pressure regulating part is in flexible response to difference in pressure between an inside and an outside of the cartridge.

DESCRIPTION OF DRAWINGS

The above and other objects, features and advantages of the present invention will become apparent from the following description of preferred embodiments given in conjunction with the accompanying drawings, in which.

DETAILED DESCRIPTION OF MAIN ELEMENTS

Figure 1:
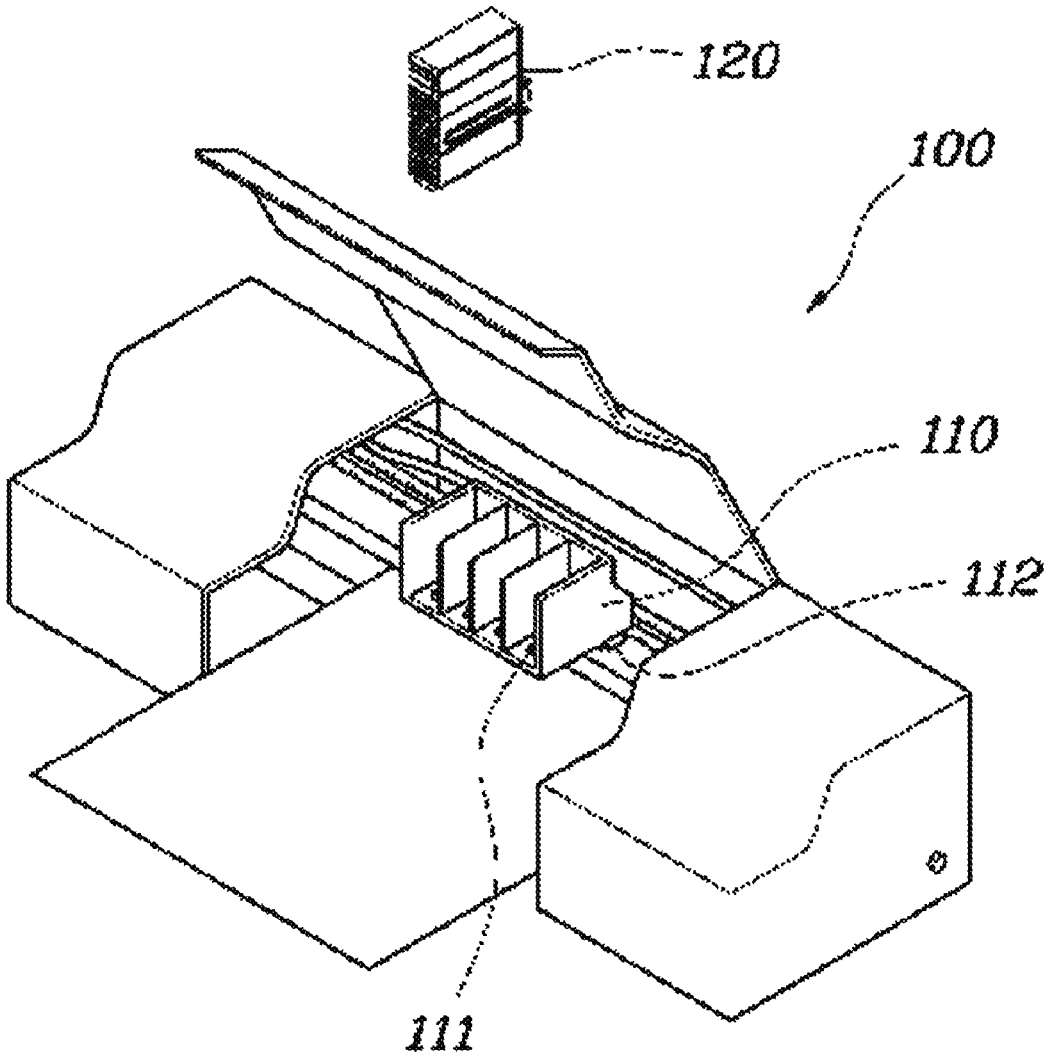
FIG. 1 is a perspective view illustrating a conventional printer.
Figure 2:
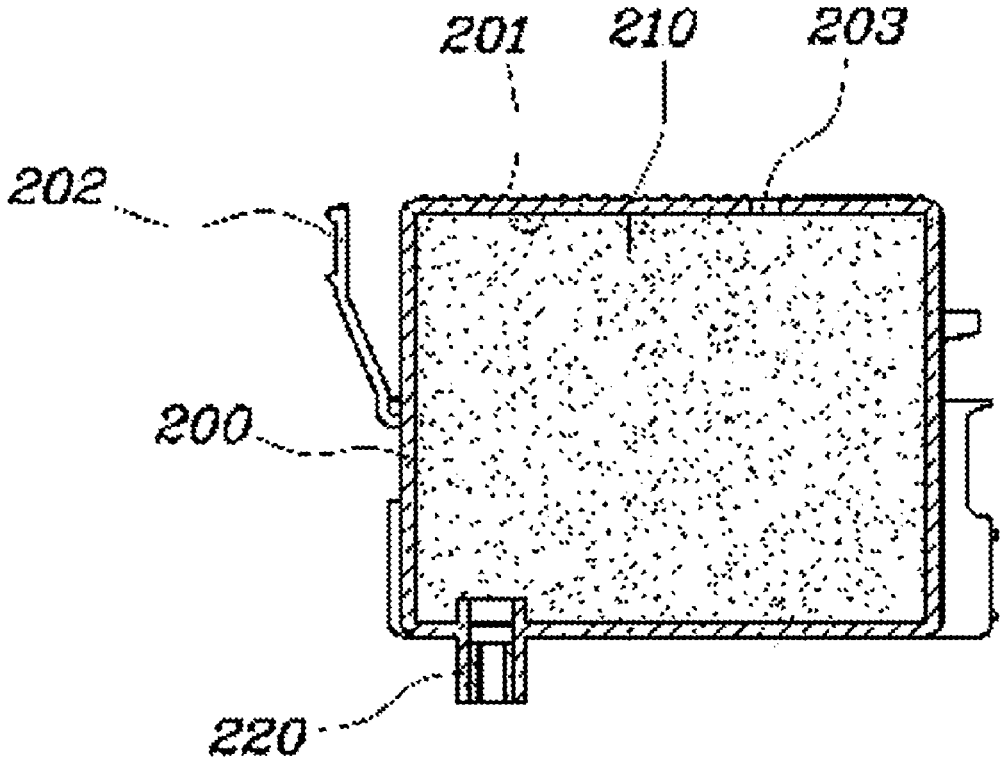
FIG. 2 is a cross-sectional view illustrating a conventional ink-cartridge.

10: body
11: filling hole
13: fixing arm
20: partition
21: connecting hole
30: filling chamber
31: discharging chamber
32: air chamber
40: ink discharging port
41: packing member
43: ink transferring channel
50: air suction valve
55: air transferring channel
56: air inducing channel
60: blocking film
70: cover
80: pressure regulating part
90: communicating port

BEST MODE

Hereinafter, the embodiments of the present invention will be described in detail with reference to accompanying drawings.

Figure 3:
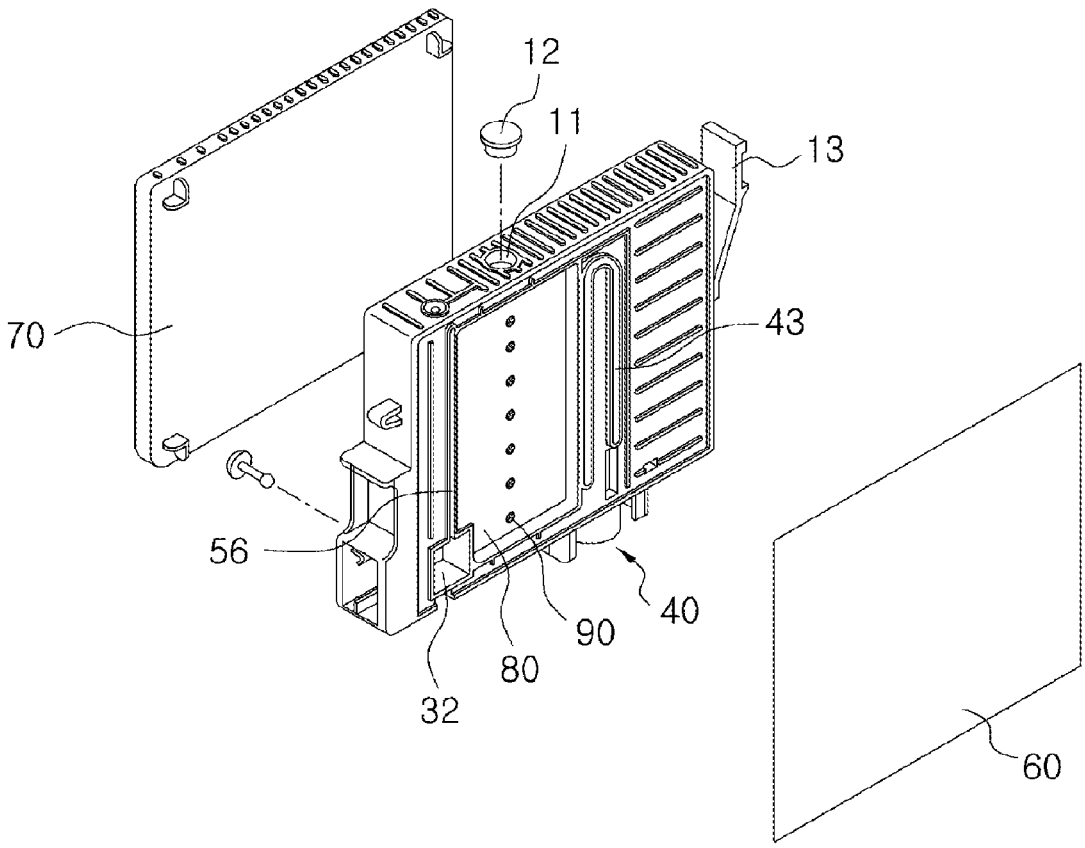
FIG. 3 is an exploded perspective view illustrating an ink-cartridge according to the present invention.
Figure 4:
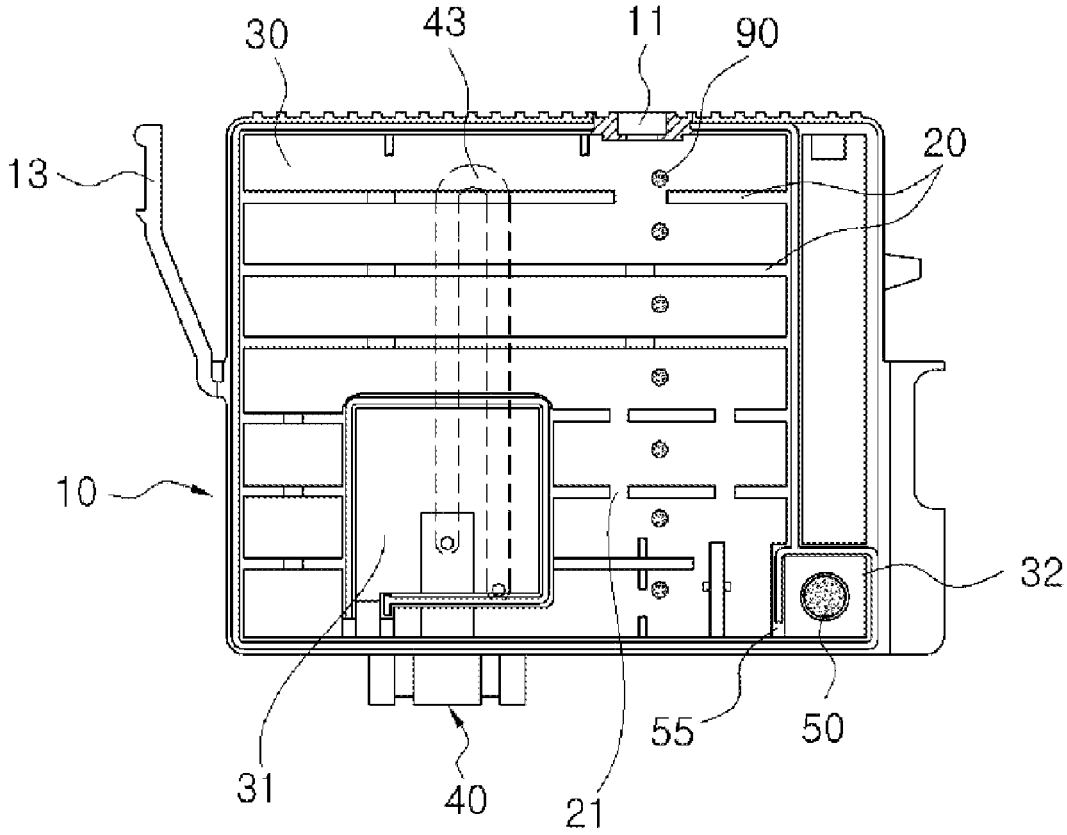
FIG. 4 is a front view illustrating the ink-cartridge according to the present invention.
Figure 5:
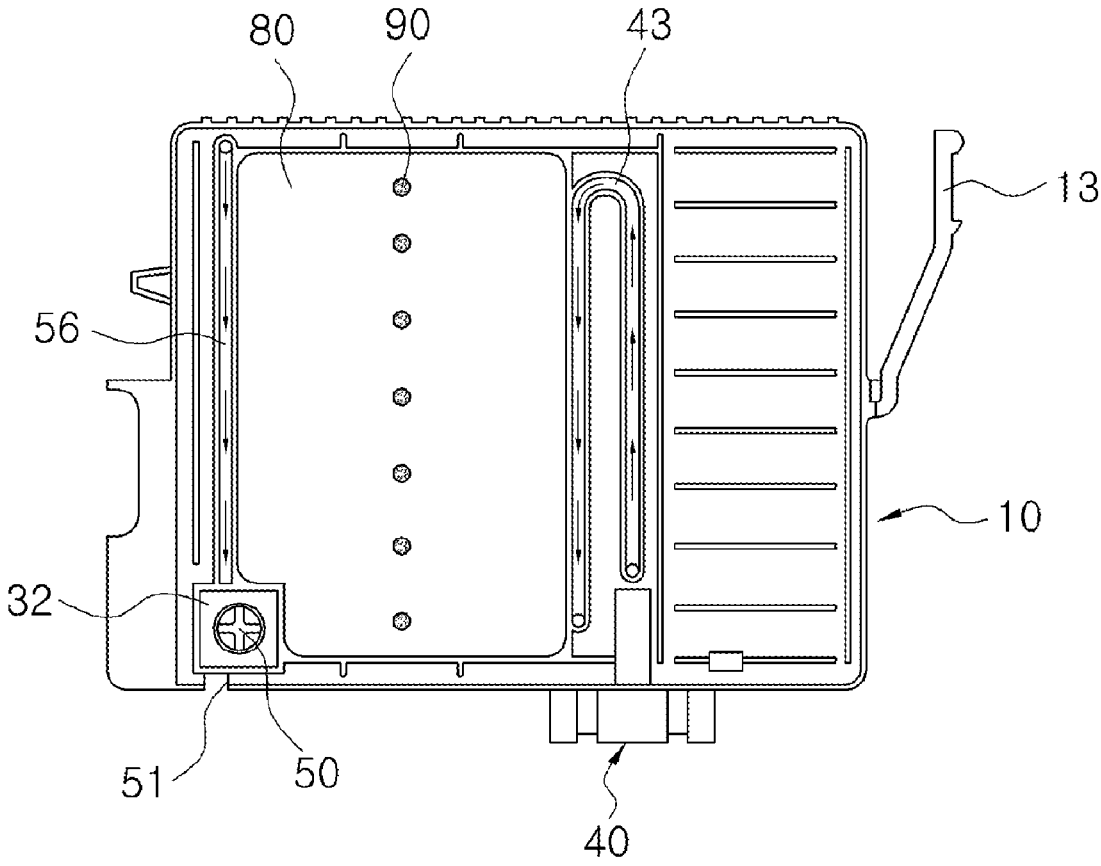
FIG. 5 is a rear view explaining ink discharging process of the ink-cartridge according to the present invention.

FIG. 3 is an exploded perspective view illustrating an ink-cartridge according to the present invention, FIG. 4 is a front view illustrating the ink-cartridge according to the present invention and FIG. 5 is a rear view explaining ink discharging process of the ink-cartridge according to the present invention.

As referred herein, the present invention is provided with a body 10 formed in a predetermined size, a filling hole 11 is formed at a top surface of the body 10, the filling hole 11 is plugged up by a rubber stopper 12 after filling ink, and a fixing arm 13 is formed at an outside surface of the body 10 so as to generate fixing force when coupled to a head which is installed on a printer. Further, a pressure regulating part 80 is formed on a surface of an outer wall of the body 10, and the pressure regulating part is communicated with a filling chamber 30 through one or more communicating ports 90 and forms a specific space by blocking film 60 which is bonded to the outer wall and has flexibility.

Inner space of the body 10 is divided into a plurality of the filling chambers 30 by partition 20, and the partition 20 is formed with connecting hole 21 so that each filling chamber 30 is connected to each other.

Meanwhile, the partition is preferably provided one or more, the partition 20 is preferably formed in horizontal direction so that the filling chambers 30 are formed in tiers and a discharging chamber 31 connected to a lowermost filling chamber 30 is formed inside the body 10.

Further, a discharging port 40 is formed at a lower surface of the body 10 and a rubber packing 41->(not shown), which can prevent ink flow in conjunction with an ink suction needle 111, is mounted inside the discharging port 40.

In addition, the discharging chamber 31 and the discharging port 40 are connected via an ink transferring channel 43, the ink transferring channel 43 is formed in an outside surface of the body 10 and an upper end portion thereof is preferably formed at higher than the upper portion of the uppermost filling chamber 30.

Meanwhile, an air chamber 32 is formed inside the body 10, the air chamber 32 and the filling chamber 30 are connected via air transferring channel 55.

Further, an air suction valve 50 is installed in the air chamber 32, and a check valve is preferably used as the air suction valve 50 so that external air can be sucked while internal air can not be discharged.

Specifically, a plurality of ribs 51 is formed at a side surface of the air chamber 32 and a pushpin shaped air suction valve 50 of which end is bulged is installed at a vacant space in a center of the ribs 51.

Further, an air inducing channel 56, which induces external air to the air suction valve 50, is formed in an outside surface of the body 10, and an upper end portion of the air inducing channel 56 is preferably formed at higher than an upper portion of the uppermost filling chamber 30 and the end of the air inducing channel 56 is formed to pass through the upper surface of the body 10.

In addition, the flexible blocking film 60 for blocking side surfaces of the ink transferring channel 43 and the air inducing channel 56 is installed in one surface of the body 10, and a cover 70 for blocking the filling chamber 30, discharging chamber 31 and the air chamber 32 is installed in the other surface of the body 10.

Operation of the present invention configured as such is described in detail as follows.

At First, when filling ink into the inside of the body 10, the ink is injected through the filling hole 11, then the ink is filled in the plurality of the filling chambers 30 and the discharging chamber 31 which are connected by the connecting hole 21, and the rubber stopper 12 is plugged up to block the filling hole 11 after completion of ink filling.

In such the state, when the ink cartridge is mounted in the head 110 of the printer 100, the fixing arm 13 formed at an outside surface of the body 10 is coupled to the head and prevents free movement of the body 10, and the discharging port 40 formed at the body 10 is coupled to an ink suction needle 111 installed in a cartridge deliverer 110.

When the printer is operated in such the state, suction force is applied to the ink suction needle 111 and then ink stored in the discharging chamber 30 is transferred to the discharging port 40 through the ink transferring channel 43. Meanwhile, as the upper end portion of the ink transferring channel 43 is at higher than the filling chamber 30, the ink is transferred only by the suction force thereby preventing the ink from being discharged excessively.

Further, as the inside of the body 10 is divided into the plurality of the filling chambers 30, free movement of the ink filled in the filling chambers 30 is minimized and thus generation of minute bubbles in the ink is prevented, and reverse flow of the ink filled in the ink suction needle 111 or head 112, due to negative pressure generated in some space of the inside of the ink-cartridge body 200 by the free movement of the ink, is prevented.

In addition, inner pressure is decreased as the ink is discharged, and the air suction valve 50 which is installed in the air chamber 32 is opened and thus air is flowed in through the air inducing channel 56 as the pressure is decreased. Meanwhile, if atmospheric temperature varies from place to place where the ink-cartridge is used, difference in temperature between the inside and the outside of the cartridge is generated and thus difference in pressure between the inside and the outside of the cartridge is generated, whereby negative pressure or excessive positive pressure is generated. Excessive ink may be flowed down through a ink discharging port 40 if the excessive positive pressure is applied to the inside of the cartridge, on the contrary ink can not be discharged properly if the negative pressure is applied to the inside of the cartridge. In this case, as the blocking film 60 of the present invention attached to the communicating port 90 of the regulating part 80 is expanded or contracted in response to the difference in pressure between the inside and the outside of the cartridge, the difference in pressure between the inside and the outside of the cartridge is naturally offset to maintain balance and thus proper amount of the ink can be discharged through a ink discharging port 40 of the cartridge.

INDUSTRIAL APPLICABILITY

The present invention, as such, has an advantage that inner space of the body is increased by removing sponge from the inside of the body while pressure inside the cartridge can be maintained uniformly.

Further, the present invention has an advantage that quality of printing matter is enhanced by preventing generation of bubbles in the ink due to free movement of the ink, and preventing instant decrement in pressure inside of the cartridge due to the free movement of the ink and resultant reverse flow of the ink.

Further, the present invention has an advantage that leakage of the ink can be prevented in advance as the air suction valve is installed in the air chamber so that air is supplied by inner pressure of the body.

In addition, the present invention has an advantage that proper amount of the ink can be discharged through ink discharging port of the cartridge as excessive positive pressure or negative pressure which can not be predicted is not applied to an inside of the cartridge by pressure regulating part which regulates the difference in pressure between the inside and the outside of the cartridge.

The invention claimed is:

1. An ink-cartridge for printers comprising:

a body formed in a predetermined size;

a filling hole passing through and formed at a top surface of the body so that ink is injected therethrough;

a filling chamber which is a space where ink is filled in the body, formed by dividing an inner space of the body into a plurality of spaces by a partition formed inside the body, the filling chamber being an inner divided space of the body;

a connecting hole passing through and formed in the partition so that the filing chambers communicate with each other;

a discharging chamber formed inside the body and in communication with the filing chamber;

a discharging port connected to the discharging chamber via an ink transferring channel formed in the body;

an air chamber connected to the filling chamber via an air transferring channel so as to supply air to the filling chamber;

an air suction valve installed in the air chamber;

an air inducing channel inducing external air to the air suction valve;

a blocking film attached to one surface of an outer wall of the body;

a cover installed on the other side surface of the body opposite to the one surface of the outer wall of the body having the blocking film attached thereto to thereby block the filling chamber and the discharging chamber; and a pressure regulating part communicating with the filling chamber through a plurality of communicating ports and having a predetermined space formed by the body and the blocking film.

2. The ink-cartridge for printers as set forth in claim 1, wherein the plurality of the communicating ports are formed in each of the plurality of filing chambers formed by dividing the inner space of the body by the partition.

3. The ink-cartridge for printers as set forth in claim 1, wherein the blocking film, which is attached to the pressure regulating part, is flexible and responds to difference in pressure between an inside and an outside of the cartridge.

4. The ink-cartridge for printers as set forth in claim 1, further comprising plural partitions installed therein.

5. The ink-cartridge for printers as set forth in claim 4, wherein communicating ports of the pressure regulating part are formed in each of the inner space of the filling chamber which is divided by the partition.

6. The ink-cartridge for printers as set forth in claim 1, wherein the ink transferring channel is formed at one surface of the outside of the body.

7. The ink-cartridge for printers as set forth in claim 6, wherein an upper end portion of the ink transferring channel is formed higher than an upper portion of the uppermost filling chamber.

8. The ink-cartridge for printers as set forth in claim 1, wherein a packing member is embedded in an inside of the discharging port.

9. The ink-cartridge for printers as set forth in claim 2, wherein the air transferring channel connecting the filling chamber with the air chamber is formed in an inside of the body.

10. The ink-cartridge for printers as set forth in claim 2, wherein the air suction valve which is selectively open/close the air chamber is a check valve which is elastically installed so as to be opened in one direction.

11. The ink-cartridge for printers as set forth in claim 2, wherein the air inducing channel inducing air into an inside of the air chamber is formed in an outside surface of the body.

12. The ink-cartridge for printers as set forth in claim 11, wherein an upper end portion of the air inducing channel is formed at higher than an upper portion of the uppermost filling chamber.

13. The ink-cartridge for printers as set forth in claim 11, wherein an end portion of the air inducing channel is formed so as to pass through an upper surface of the body.

* * * * *